US010770253B2

(12) United States Patent
Khlat et al.

(10) Patent No.: US 10,770,253 B2
(45) Date of Patent: Sep. 8, 2020

(54) SWITCH ARRANGEMENTS FOR MICROELECTROMECHANICAL SYSTEMS

(71) Applicant: Qorvo US, Inc., Greensboro, NC (US)

(72) Inventors: Nadim Khlat, Cugnaux (FR); Jonathan Hale Hammond, Oak Ridge, NC (US)

(73) Assignee: Qorvo US, Inc., Greensboro, NC (US)

( * ) Notice: Subject to any disclaimer, the term of this patent is extended or adjusted under 35 U.S.C. 154(b) by 136 days.

(21) Appl. No.: 16/174,416

(22) Filed: Oct. 30, 2018

(65) Prior Publication Data

US 2019/0172671 A1 Jun. 6, 2019

Related U.S. Application Data

(60) Provisional application No. 62/593,549, filed on Dec. 1, 2017.

(51) Int. Cl.
*H01H 59/00* (2006.01)
*H01H 9/38* (2006.01)
*H01H 9/40* (2006.01)

(52) U.S. Cl.
CPC ..... *H01H 59/0009* (2013.01); *H01H 9/38* (2013.01); *H01H 9/40* (2013.01); *H01H 2059/0063* (2013.01)

(58) Field of Classification Search
CPC ..... H01H 59/0009; H01H 9/38; H01H 9/40; H01H 2059/0063
USPC ..... 307/115
See application file for complete search history.

(56) References Cited

U.S. PATENT DOCUMENTS 7,864,491 B1 1/2011 Bauder et al.
9,156,677 B2 10/2015 Bauder et al.

OTHER PUBLICATIONS

Basu, Anirban, et al., "Leading and Trailing Edge Hot Switching Damage in a Metal Contact RF MEMS Switch," Transducers and Eurosensors, Jun. 2013, Barcelona, Spain, IEEE, pp. 514-517.
Dickrell, Daniel, III, et al., "Electrical Contact Resistance Degradation of a Hot-Switched Simulated Metal MEMS Contact," vol. 30, Issue 1, Mar. 2007, IEEE, pp. 75-80.

*Primary Examiner* — Hal Kaplan
(74) *Attorney, Agent, or Firm* — Withrow & Terranova, P.L.L.C.

(57) ABSTRACT

Microelectromechanical system (MEMS) switches that provide low contact resistance over a large number of open and close contact cycles are disclosed. A MEMS switch device may include a plurality of parallel MEMS switches with a first MEMS switch that is configured differently in such a manner to close first and/or open last during open and close cycles. In this regard, the first MEMS switch may experience increased contact resistance over a large number of open and close cycles while other MEMS switches maintain a low contact resistance. In certain embodiments, the first MEMS switch is controlled by a different control signal to open and close differently than the other MEMS switches. In certain embodiments, a common control signal controls a plurality of MEMS switches and the first MEMS switch is mechanically different such that it opens and closes differently than other MEMS switches.

20 Claims, 9 Drawing Sheets

SWITCH ARRANGEMENTS FOR MICROELECTROMECHANICAL SYSTEMS

RELATED APPLICATIONS

This application claims the benefit of provisional patent application Ser. No. 62/593,549, filed Dec. 1, 2017, the disclosure of which is hereby incorporated herein by reference in its entirety.

FIELD OF THE DISCLOSURE

The present invention relates to microelectromechanical system (MEMS) switch devices, and in particular to arrangements for MEMS switch devices and related methods.

BACKGROUND

As electronics evolve, there is an increased need for miniature switches that are provided on semiconductor substrates along with other semiconductor components to form various types of circuits. These miniature switches often act as relays, generally range in size from a micrometer to a millimeter, and are generally referred to as microelectromechanical system (MEMS) switches.

In some applications, MEMS switches are configured as switches and replace field effect transistors (FETs). Such MEMS switches reduce insertion losses due to added resistance, and reduce parasitic capacitance and inductance inherent in providing FET switches in a signal path. MEMS switches are currently being deployed in many radio frequency (RF) applications, such as antenna switches, load switches, transmit/receive switches, tuning switches, and the like. For instance, transmit/receive systems requiring complex RF switching capabilities may utilize a MEMS switch.

For such applications, MEMS switches are subjected to a large number of open and close contact cycles where switch contacts are actuated between an open position where corresponding contacts are spaced apart and a closed position where corresponding contacts are in contact with each other. As the open and close contact cycles are repeated, maintaining a low overall contact resistance for the MEMS switches can be challenging for a number of reasons. For example, residual manufacturing contaminants may be present on one or both of the corresponding contacts that can contribute to reduced contact area during repeated open and close cycles, thereby increasing contact resistance. In a similar manner, material transfer between the corresponding contacts after repeated open and close cycles can contribute to an increased contact resistance. Additionally, MEMS switches may be subjected to hot switching events that can exacerbate the problems associated with contaminants and/or material transfer. During switching cycles, a difference in potential may be present across corresponding contacts during the periods in which the corresponding contacts approach each other, touch, and separate from one another. When the distance between the corresponding contacts is small, electric fields can enable field emission of electrons and eventually breakdown and arcing between the corresponding contacts. This can lead to significant material transfer between the corresponding contacts, which in turn can reduce contact force and/or contact area, thereby increasing contact resistance. Additionally, this can lead to pyrolysis, or thermal decomposition, at contact surfaces which can create non-conductive and load bearing films.

The art continues to seek improved MEMS switches that provide desirable performance characteristics over multiple open and close cycles while being capable of overcoming challenges associated with conventional MEMS switches.

SUMMARY

The present disclosure relates to microelectromechanical system (MEMS) switches and more particularly to arrangements for MEMS switches that provide a low contact resistance over a large number of open and close contact cycles. In certain embodiments, a MEMS switch device may include a plurality of parallel MEMS switches and at least one of the MEMS switches is configured differently in such a manner to close first and/or open last during open and close cycles. In this regard, the MEMS switch that closes before and/or opens after the other MEMS switches may experience increased contact resistance over a large number of open and close cycles while the other MEMS switches maintain a low contact resistance. In certain embodiments, at least one of the MEMS switches is controlled by a different control signal to open and close differently than other MEMS switches. In certain embodiments, a common control signal controls a plurality of MEMS switches and at least one of the MEMS switches is mechanically different such that it opens and closes differently than other MEMS switches.

In one aspect, a MEMS switch device comprises: a first MEMS switch configured to receive a first MEMS switch control signal; a plurality of second MEMs switches configured to receive a second MEMS switch control signal that is different than the first MEMS switch control signal, wherein the first MEMS switch and the plurality of second MEMS switches are arranged in parallel with each other; and control circuitry configured to provide the first MEMS switch control signal and the second MEMS switch control signal. In certain embodiments, the first MEMS switch is configured to close before the plurality of second MEMS switches close during an open and close cycle. In certain embodiments, the first MEMS switch is configured to reopen after the plurality of second MEMS switches reopen during the open and close cycle. In certain embodiments, the first MEMS switch is configured to (i) close before the plurality of second MEMS switches close, (ii) reopen after the plurality of second MEMS switches close, (iii) close again before the plurality of second MEMS switches open, and (iv) reopen again after the plurality of second MEMS switches open during an open and close cycle.

In certain embodiments, the MEMS switch device may further comprise a resistor configured in series with the first MEMS switch.

In certain embodiments, the MEMS switch device may further comprise an additional MEMS switch arranged in parallel with the first MEMS switch and the plurality of second MEMS switches, wherein the additional MEMS switch is configured to receive the first MEMS switch control signal. In further embodiments, a resistor is configured in series with the first MEMS switch and the additional MEMS switch.

In certain embodiments, the MEMS switch device may further comprise a plurality of additional switches arranged in parallel with the first MEMS switch and the plurality of second MEMS switches, wherein the plurality of additional MEMS switches are configured to receive the first MEMS switch control signal. In certain embodiments, the MEMS switch device may further comprising a shunt device that is connected to ground. The shunt device may comprise a shunt MEMS switch configured to receive a third MEMS switch control signal. The plurality of second MEMS switches may comprise a range of about two to about one hundred MEMS switches.

In one aspect, a method of operating a MEMS switch device comprises: providing a plurality of MEMS switches that are arranged in parallel with each other; closing a first MEMS switch of the plurality of MEMS switches before closing a second MEMS switch of the plurality of MEMS switches; and opening the second MEMS switch of the plurality of MEMS switches before opening the first MEMS switch of the plurality of MEMS switches. Closing the first MEMS switch may comprise sending a first MEMS switch control signal to the first MEMS switch, and closing the second MEMS switch comprises sending a second MEMS switch control signal to the second MEMS switch. In other embodiments, closing the first MEMS switch and closing the second MEMS switch may comprise sending a common MEMS switch control signal to both the first MEMS switch and the second MEMS switch.

In another aspect, a MEMS switch device comprises: a plurality of MEMS switches that are arranged in parallel with each other, wherein the plurality of MEMS switches are configured to receive a common MEMS switch control signal; and control circuitry configured to provide the common MEMS switch control signal; wherein a first MEMS switch of the plurality of MEMS switches is configured to close before a second MEMS switch of the plurality of MEMS switches in response to the common MEMS switch control signal. In certain embodiments, the first MEMS switch of the plurality of MEMS switches is configured to open after the second MEMS switch of the plurality of MEMS switches in response to the common MEMS switch control signal. In certain embodiments, the first MEMS switch comprises a first switch contact over a substrate and the second MEMS switch comprises a second switch contact over the substrate, and in an open position, the first switch contact is configured closer to the substrate than the second switch contact. In certain embodiments, the first MEMS switch comprises a first actuator and the second MEMS switch comprises a second actuator, and the second actuator has a higher spring constant than the first actuator. In certain embodiments, the first MEMS switch comprises a lighter mass than the second MEMS switch. The plurality of MEMS switches may comprise a range of about two to about one hundred MEMS switches.

In another aspect, any of the foregoing aspects, and/or various separate aspects and features as described herein, may be combined for additional advantage. Any of the various features and elements as disclosed herein may be combined with one or more other disclosed features and elements unless indicated to the contrary herein.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
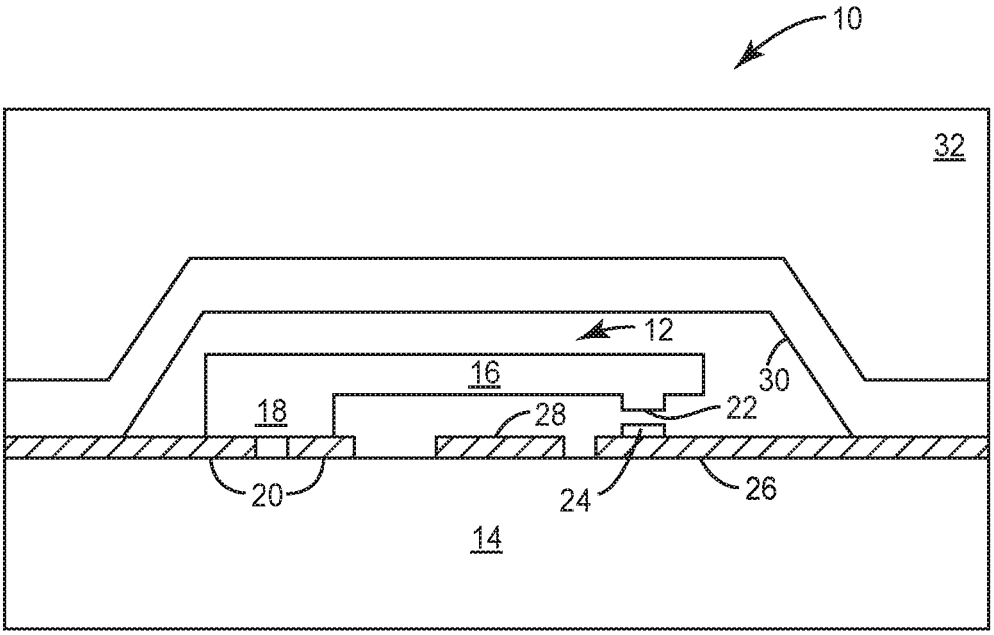
FIG. 1A RELATED ART
FIGS. 1A and 1B illustrate a representative microelectromechanical system (MEMS) switch in an open and closed position, respectively.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present disclosure relates to microelectromechanical system (MEMS) switches and more particularly to arrangements for MEMS switches that provide a low contact resistance over a large number of open and close contact cycles. In certain embodiments, a MEMS switch device may include a plurality of parallel MEMS switches and at least one of the MEMS switches is configured differently in such a manner to close first and/or open last during open and close cycles. In this regard, the MEMS switch that closes before and/or opens after the other MEMS switches may experience an increased contact resistance over a large number of open and close cycles while the other MEMS switches maintain a low contact resistance. In certain embodiments, at least one of the MEMS switches is controlled by a different control signal to open and close differently than other MEMS switches. In certain embodiments, a common control signal controls a plurality of MEMS switches and at least one of the MEMS switches is mechanically different such that it opens and closes differently than other MEMS switches.

Figure 1B:
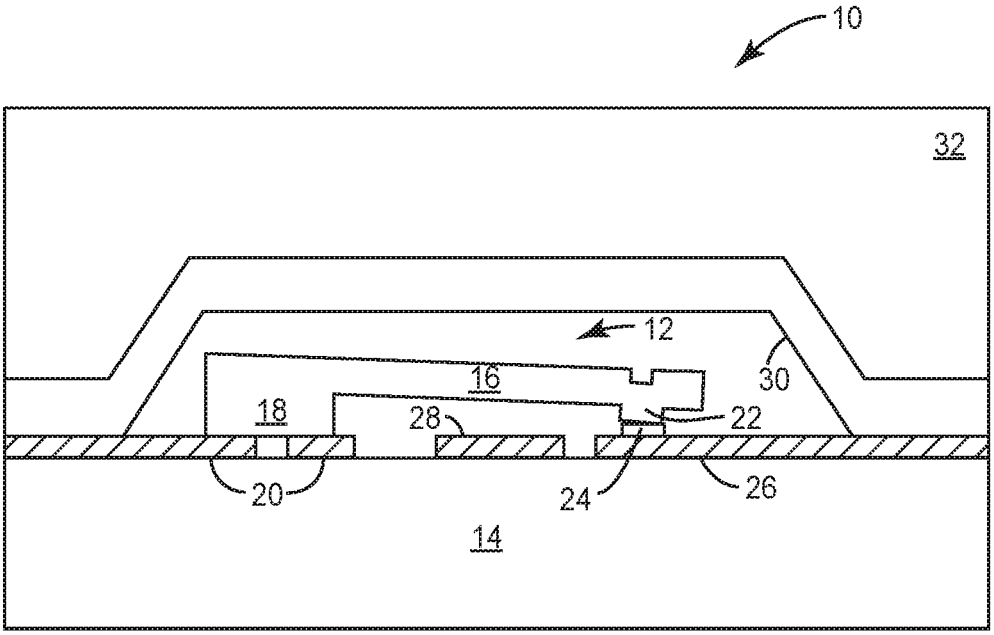
FIG. 1B RELATED ART

Before describing particular embodiments of the present disclosure further, a general discussion of MEMS switch devices is provided. Turning to FIGS. 1A and 1B, a MEMS device 10 having a main MEMS switch 12 is illustrated. The main MEMS switch 12 is formed on an appropriate substrate 14. In certain embodiments, the substrate 14 may comprise a semiconductor or insulator substrate, examples of which may include silicon, glass, and glass-fiber composite materials. The main MEMS switch 12 includes an actuator 16, which is formed from a conductive material, such as gold. The actuator 16 has a first end and a second end. The first end is coupled to the substrate 14 by an anchor 18. The first end of the actuator 16 is also electrically coupled to a first conductive pad 20 at or near the point where the actuator 16 is anchored to the substrate 14. Notably, the first conductive pad 20 may play a role in anchoring the first end of the actuator 16 to the substrate 14 as depicted. The first conductive pad 20 may form a portion of or be connected to a first terminal (not shown) of the main MEMS switch 12.

The second end of the actuator 16 forms or is provided with a switch contact 22, which is suspended over a corresponding terminal contact 24 and/or a second conductive pad 26. The second conductive pad 26 may form a portion of or be connected to a second terminal (not shown) of the main MEMS switch 12. Thus, when the main MEMS switch 12 is actuated, the actuator 16 moves the switch contact 22 into electrical contact with the terminal contact 24 of the second conductive pad 26 to electrically connect the first conductive pad 20 to the second conductive pad 26. To actuate the main MEMS switch 12, and in particular to cause the actuator 16 to move the switch contact 22 into contact with the terminal contact 24 of the second conductive pad 26, an actuator plate 28 is formed over a portion of the substrate 14, preferably under the middle portion of the actuator 16. To actuate the main MEMS switch 12, an electrostatic voltage is applied to the actuator plate 28. The presence of the electrostatic voltage creates an electromagnetic field that effectively moves the actuator 16 against a restoring force toward the actuator plate 28 from an "open" position illustrated in FIG. 1A to a "closed" position illustrated in FIG. 1B. Likewise, removing the electrostatic voltage from the actuator plate 28 releases the actuator 16 for return to the open position illustrated in FIG. 1A. As illustrated, the open position occurs when the switch contact 22 is out of contact with the terminal contact 24, and the closed position occurs when the switch contact 22 comes into contact with the terminal contact 24. Other embodiments may differ. The main MEMS switch 12 may be encapsulated by one or more encapsulation layers 30, which form a substantially hermetically sealed cavity around the actuator 16. The cavity is generally filled with an inert gas and sealed in a near vacuum state. Once the encapsulation layers 30 are in place, an overmold 32 may be provided over the encapsulation layers 30. In FIGS. 1A and 1B, the actuator 16 is illustrated as a cantilever actuator where the first end is anchored and the second end is suspended. According to embodiments disclosed herein, the actuator 16 may comprise other configurations as well, including a membrane actuator where both ends are anchored and the membrane actuator flexes between the two ends.

In light of the electromechanical structure of the main MEMS switch 12, the main MEMS switch 12 cannot provide switching action as fast as typical solid state switches, such as n-type metal-oxide-semiconductor field effect transistor (NMOSFET) switches. A switching time of the main MEMS switch 12 typically depends upon the electromagnetic field applied to the actuator 16, a mass of the actuator 16, and a restoring force or spring constant of the actuator 16. However, an FET switch may generate higher insertion loss than is generated by the main MEMS switch 12. Moreover, at high power levels in a radio frequency (RF) circuit (not shown), parasitic capacitance at semiconductor junctions of the FET switch may alter RF signals.

During switching events, such as a hot switching event, a difference in potential between the switch contact 22 and the terminal contact 24 may cause an electrical arc resulting from an electrical current flowing through normally non-conductive media, such as air. Undesired or unintended electrical arcing may have detrimental effects on the switch contact 22 and the terminal contact 24 of the main MEMS switch 12. For instance, as the main MEMS switch 12 is being either actuated to the closed position of FIG. 1B or released to the open position of FIG. 1A, arcing from a difference in potential between the switch contact 22 and the terminal contact 24 may cause significant aging, unintended wear and tear, degradation, sticking, destruction, significant material transfer, and/or reduced contact area of one or both of the switch contact 22 and the terminal contact 24. Unintended power dissipation through arcing should be limited for optimum contact lifetime with a low contact resistance of the switch contact 22 and the terminal contact 24.

Figure 2A:
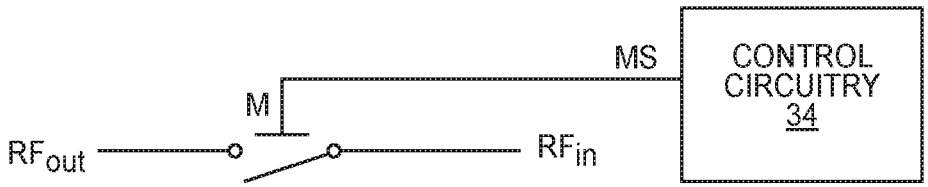
FIG. 2A RELATED ART
FIG. 2A illustrates a block diagram of a single MEMS switch arranged between a radio frequency (RF) input and an RF output.
Figure 2B:
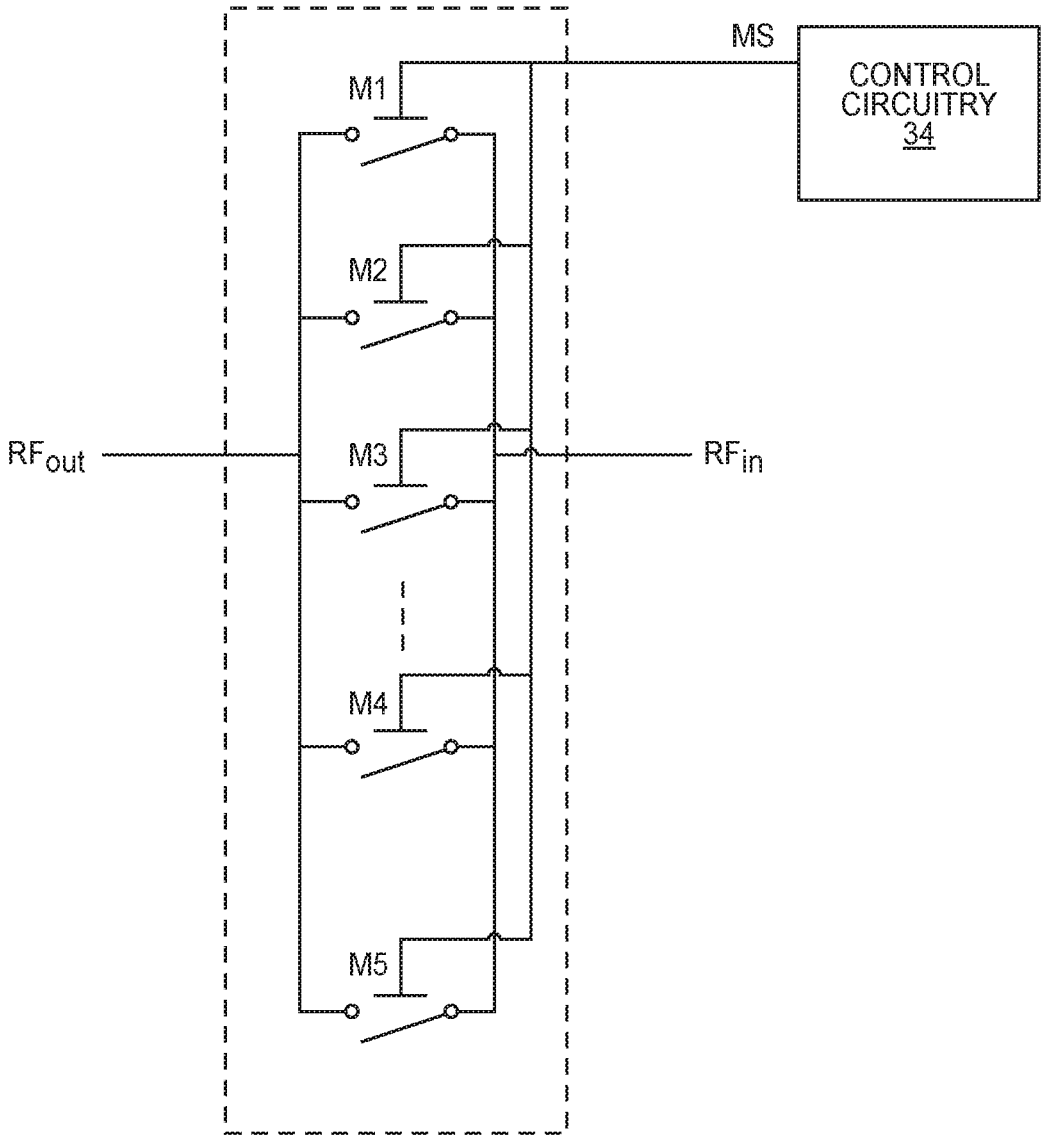
FIG. 2B RELATED ART
FIG. 2B illustrates a block diagram of a plurality of MEMS switches arranged in parallel between an RF input and an RF output.

In various RF applications, MEMS switch devices may include a single switch or a plurality of parallel switches. For instance, FIG. 2A illustrates a block diagram of a single MEMS switch M arranged between an RF input ($RF_{in}$) terminal and an RF output ($RF_{out}$) terminal. Control circuitry 34 provides a MEMS switch control signal MS to control actuation of the single MEMS switch M. In operation, an increased contact resistance may be realized with any degradation of the single MEMS switch M. FIG. 2B illustrates a block diagram of a plurality of MEMS switches M1 to M5 arranged in parallel between the RF input ($RF_{in}$) and the RF output ($RF_{out}$). In this arrangement, the MEMS switch control signal MS from the control circuitry 34 controls actuation of the plurality of MEMS switches M1 to M5. While five MEMS switches are illustrated in in FIG. 2B, there may be any number of parallel (N-parallel) MEMS switches as indicated by the vertical dashed line between M3 and M4. In certain embodiments, the N-parallel MEMS switches may comprise a number in a range of about two to about one hundred MEMS switches or more. In certain embodiments, the plurality of MEMS switches M1 to M5 may comprise a smaller size than the single MEMS switch M of FIG. 2A. In operation, each of the plurality of MEMS switches M1 to M5 contribute to an overall contact resistance and as individual ones of the MEMS switches M1 to M5 experience degradation, the overall contact resistance is increased.

In certain embodiments disclosed herein, a MEMS switch device includes at least a first MEMS switch and a second MEMS switch that are arranged in parallel with each other. Control circuitry is configured to provide a separate MEMS switch control signal to each of the first MEMS switch and the second MEMS switch. This configuration allows the first MEMS switch to be separately controlled to close before the second MEMS switch closes and/or open after the second MEMS switch is opened in an open and close cycle. In this manner, a common potential is established by the first MEMS switch while the second MEMS switch opens and closes. Accordingly, the first MEMS switch may experience arcing and degradation over a number of open and close cycles while arcing in the second MEMS switch is reduced. In certain embodiments, a first MEMS switch may operate in such a manner to reduce arcing in a plurality of second MEMS switches.

Figure 3:
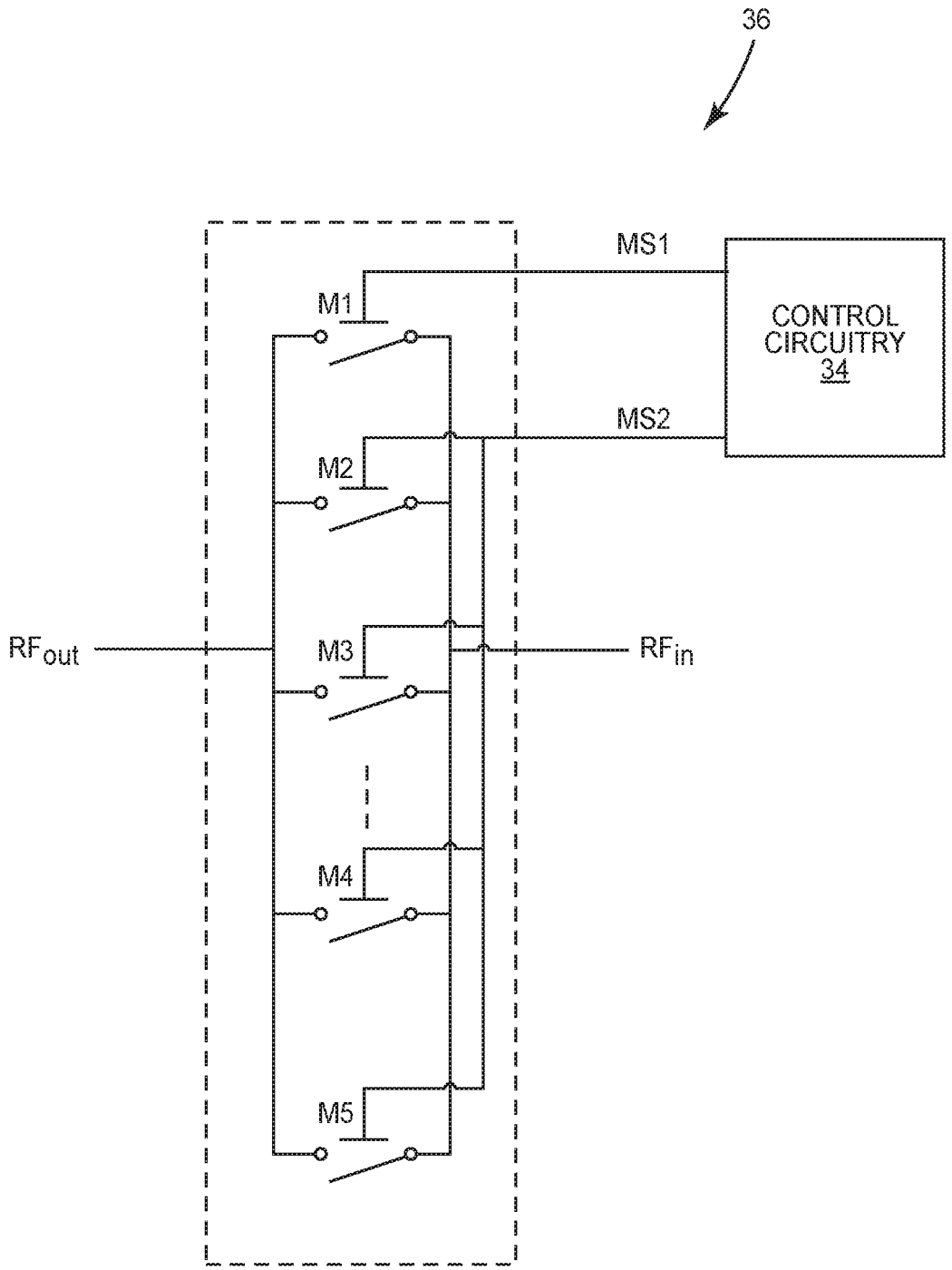
FIG. 3 illustrates a block diagram of a MEMS switch device according to embodiments disclosed herein.

FIG. 3 illustrates a block diagram of a MEMS switch device 36 according to embodiments disclosed herein. In FIG. 3, the plurality of MEMS switches M1 to M5 are arranged in parallel between the RF input ($RF_{in}$) and the RF output ($RF_{out}$) as previously described. While five MEMS switches are illustrated, there may be any number of parallel (N-parallel) MEMS switches as indicated by the vertical dashed line between the MEMS switches M3 and M4. In certain embodiments, the N-parallel MEMS switches may comprise a number in a range of about two to about one hundred MEMS switches or more. The control circuitry 34 in FIG. 3 is configured to provide a first MEMS switch control signal MS1 and a second MEMS switch control signal MS2 that may be different than the first MEMS switch control signal MS1. A first MEMS switch M1 is configured to receive the first MEMS switch control signal MS1 and a plurality of second MEMS switches M2 to M5 are configured to receive the second MEMS switch control signal MS2. During repeated open and close cycles, the first MEMS switch M1 is configured to close in response to the first MEMS switch control signal MS1 before the plurality of second MEMS switches M2 to M5 close in response to the second MEMS switch control signal MS2. Additionally, the first MEMS switch M1 may be configured to reopen after the plurality of second MEMS switches M2 to M5 reopen during the open and close cycle. In this manner, the first MEMS switch M1 establishes a common potential between the $RF_{in}$ and the $RF_{out}$ while the plurality of second MEMS switches M2 to M5 actuate between open and closed positions. While the first MEMS switch M1 may experience arcing, degradation, and an increased contact resistance over a number of open/close cycles, arcing and degradation is reduced in the plurality of second MEMS switches M2 to M5, thereby increasing the lifetime of the MEMS switch device 36 while maintaining a low overall or average contact resistance. Accordingly, the first MEMS switch M1 serves as a degradation protection switch for the plurality of second MEMS switches M2 to M5. In this regard, a method of operating the MEMS switch device 36 may include providing a plurality of MEMS switches M1 to M5 that are arranged in parallel with each other, closing a first MEMS switch M1 of the plurality of MEMS switches before closing a second MEMS switch M2 to M5 of the plurality of MEMS switches, and opening the second MEMS switch M2 to M5 of the plurality of MEMS switches before opening the first MEMS switch M1 of the plurality of MEMS switches. In certain embodiments, closing the first MEMS switch M1 comprises sending the first MEMS switch control signal MS1 to the first MEMS switch M1, and closing the second MEMS switch M2 to M5 comprises sending a second MEMS switch control signal MS2 to the second MEMS switch M2 to M5.

Figure 4A:
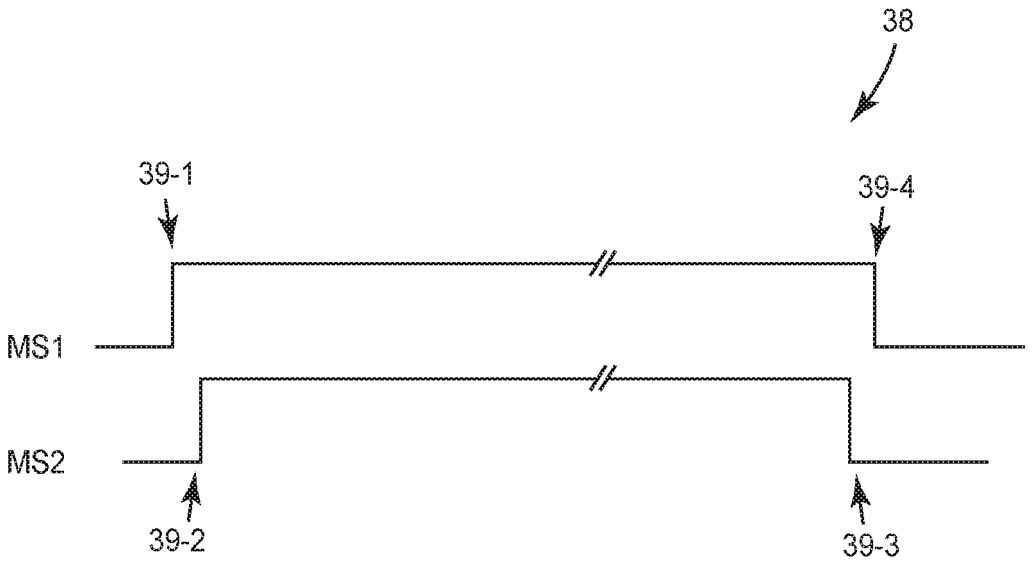
FIG. 4A illustrates a timing diagram of a first MEMS switch control signal and a second MEMS switch control signal for the MEMS switch device of FIG. 3 during an open and close cycle.

FIG. 4A illustrates a timing diagram 38 of the first MEMS switch control signal MS1 and the second MEMS switch control signal MS2 for the MEMS switch device 36 of FIG. 3 during an open and close cycle. At a first time 39-1, the first MEMS switch control signal MS1 signals the first MEMS switch (M1 of FIG. 3) to actuate to a closed position, thereby establishing a common potential as previously described. At a second time 39-2 that comes after the first time 39-1, the second MEMS switch control signal MS2 signals the second MEMS switches (M2 to M5 of FIG. 3) to also actuate to a closed position. Since the common potential has already been established, about the same voltage is provided across the $RF_{in}$ and the $RF_{out}$ at the second time 39-2, thereby reducing arcing effects for the second MEMS switches (M2 to M5 of FIG. 3). At a later third time 39-3, the second MEMS switch control signal MS2 signals the second MEMS switches (M2 to M5 of FIG. 3) to also actuate to an open position, followed by the first MEMS switch control signal MS1 signaling the first MEMS switch (M1 of FIG. 3) to subsequently actuate to an open position at a later fourth time 39-4.

Figure 4B:
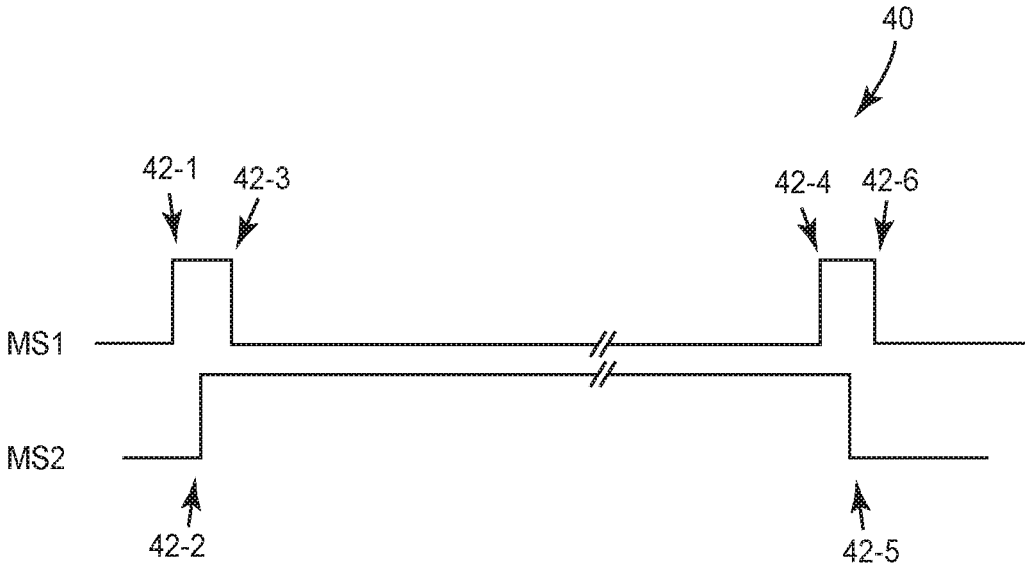
FIG. 4B illustrates an alternative timing diagram of the first MEMS switch control signal and the second MEMS switch control signal for the MEMS switch device of FIG. 3 during an open and close cycle.

FIG. 4B illustrates an alternative timing diagram 40 of the first MEMS switch control signal MS1 and the second MEMS switch control signal MS2 for the MEMS switch device 36 of FIG. 3 during an open and close cycle. In FIG. 4B, the first MEMS switch control signal MS1 and the second MEMS switch control signal MS2 respectively signal the first MEMS switch (M1 of FIG. 3) and the plurality of second MEMS switches (M2 to M5 of FIG. 3) at various sequential times 42-1 to 42-6. As illustrated in the timing diagram 40, the first MEMS switch (M1 of FIG. 3) is configured to (i) close at a first time 42-1 before the plurality of second MEMS switches (M2 to M5 of FIG. 3) close at a second time 42-2, (ii) reopen at a third time 42-3 after the plurality of second MEMS switches (M2 to M5 of FIG. 3) close at the second time 42-2, (iii) close again at a fourth time 42-4 before the plurality of second MEMS switches (M2 to M5 of FIG. 3) open at a fifth time 42-5, and (iv) reopen again at a sixth time 42-6 after the plurality of second MEMS switches (M2 to M5 of FIG. 3) open at the fifth time 42-5 during an open and close cycle. As previously described, the first MEMS switch (M1 of FIG. 3) may degrade and have an increased contact resistance over a number of open/close cycles. In the timing diagram 40 of FIG. 4B, the first MEMS switch (M1 of FIG. 3) reopens for a portion of time while the plurality of second MEMS switches (M2 to M5 of FIG. 3) are closed so as to reduce any negative impact of the first MEMS switch (M1 of FIG. 3) on the overall contact resistance of the MEMS switch device 36.

Figure 5A:
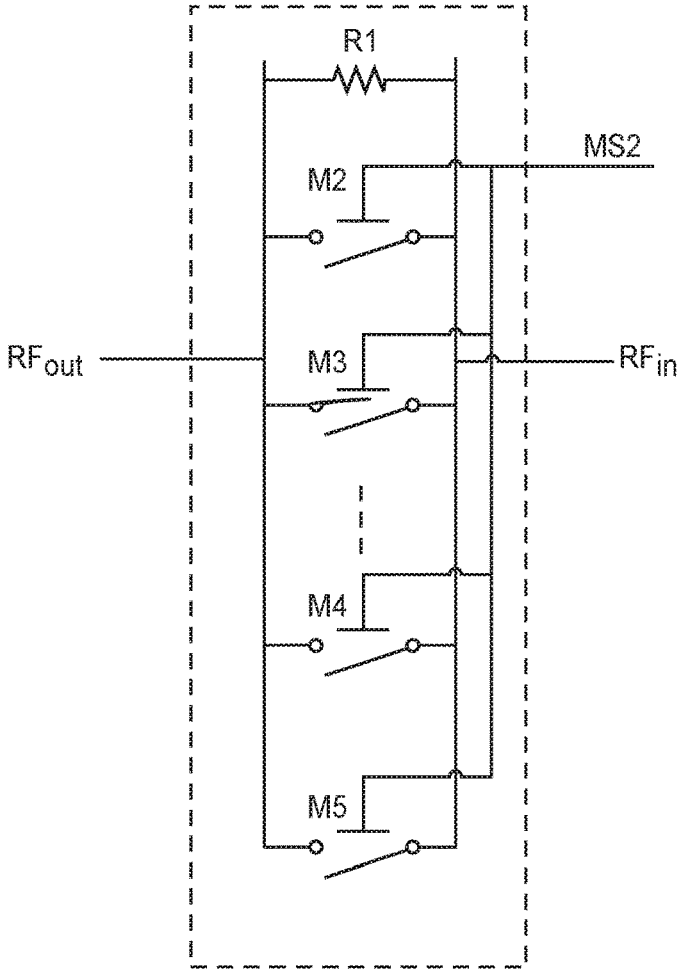
FIGS. 5A and 5B are block diagrams illustrating a contact resistance of a first MEMS switch in the MEMS switch device of FIG. 3.
Figure 5B:
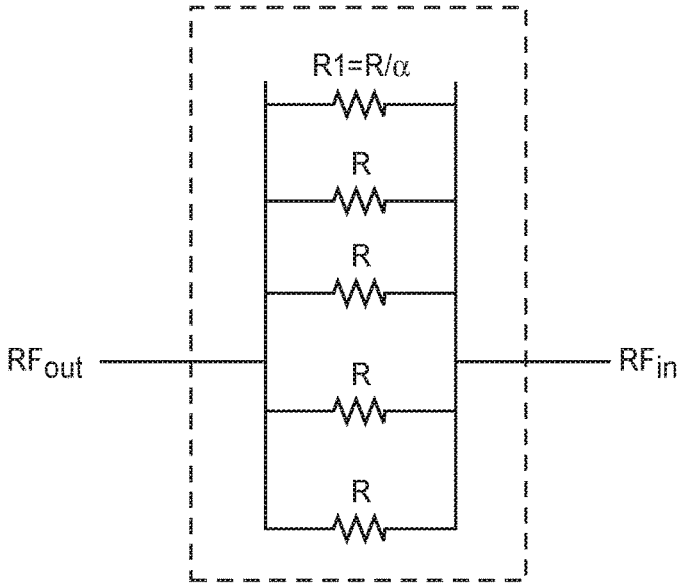

FIGS. 5A and 5B are block diagrams illustrating the contact resistance of the first MEMS switch (M1 of FIG. 3) in the MEMS switch device 36 of FIG. 3. In FIG. 5A, the first MEMS switch (M1 of FIG. 3) is represented as having a first resistance R1 in parallel with the plurality of second MEMS switches M2 to M5. In FIG. 5B, the plurality of second MEMS switches (M2 to M5 of FIG. 5A) are represented as having the same second resistance R. Before the first MEMS switch (M1 of FIG. 3) experiences degradation, the first resistance R1 may be equal to the second resistance R. In the parallel arrangement where R1=R, a total resistance $R_{tot}$ may be represented as $R_{tot}=R/N$, where N is the total number of resistors (M1 to M5 in this case). After degradation of the first MEMS switch (M1 of FIG. 3), the first resistance R1 may have a higher resistance value as represented by $R1=R/\alpha$ where $0<\alpha\leq 1$. Accordingly, the total resistance $R_{tot}$ may be represented as $R_{tot}=R/(N-1+\alpha)$ where $0<\alpha\leq 1$ and N−1 represents the total number of second MEMS switches M2 to M5 that have not degraded. In this manner, the total resistance $R_{tot}$ will be bounded by R/N (no degradation in M1) and $R/(N-1+\alpha)$ (degradation in M1). Notably, no matter how high a resistance value the first resistance R1 degrades to, the total resistance $R_{tot}$ will remain less than R/(N−1). By way of a non-limiting example, if a MEMS switch device includes 5 switches that all have a resistance value of 1 ohms (Ω), then the total resistance $R_{tot}=0.2\Omega$. If a first MEMS switch of the same MEMS switch device degrades to a resistance value of 10Ω, the total resistance $R_{tot}=0.24\Omega$. Accordingly, for a MEMS switch device with a large number of switches, limiting the degradation to a single switch or a few switches only has a minimal impact on the total resistance of the MEMS device.

Figure 6:
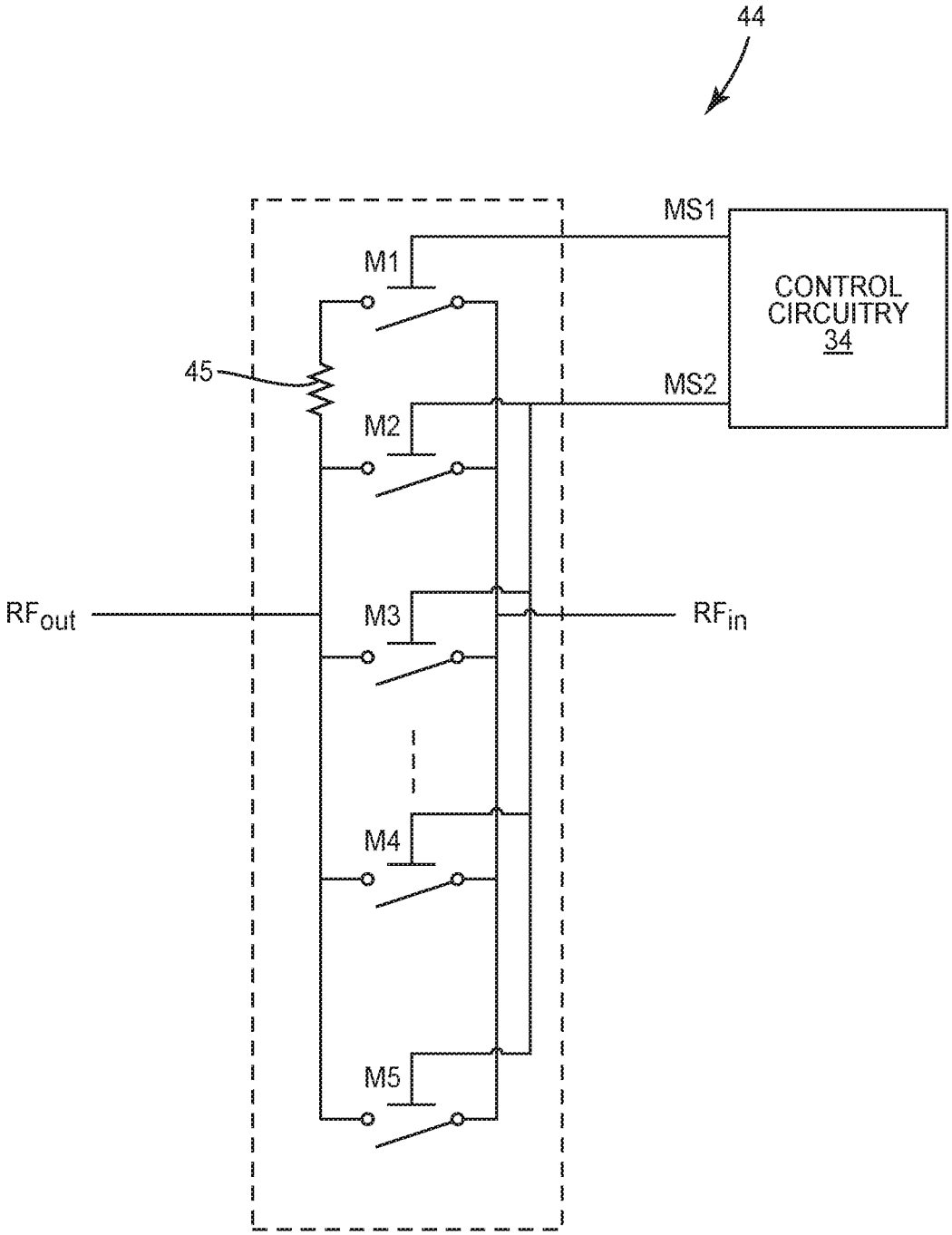
FIG. 6 illustrates a block diagram of a MEMS switch device according to embodiments disclosed herein that includes a resistor in series with a first MEMS switch.

FIG. 6 illustrates a block diagram of a MEMS switch device 44 according to embodiments disclosed herein that includes a resistor 45 in series with the first MEMS switch M1. The block diagram additionally illustrates the control circuitry 34 configured to provide the first MEMS switch control signal MS1 to the first MEMS switch M1 and the second MEMS switch control signal MS2 to the plurality of second MEMS switches M2 to M5 as previously described. While five MEMS switches are illustrated, there may be any number of parallel (N-parallel) MEMS switches as indicated by the vertical dashed line between the second MEMS switches M3 and M4. In certain embodiments, the N-parallel MEMS switches may comprise a number in a range of about two to about one hundred MEMS switches or more. In operation, high current pulses may be present when the first MEMS switch M1 opens or closes that further contribute to degradation of the first MEMS switch M1. In FIG. 6, the resistor 45 is added in series with the first MEMS switch M1 to limit current flow and reduce the impact of such high current pulses. In this regard, the first MEMS switch M1 may be protected from high current pulses while continuing to provide degradation protection to the plurality of second MEMS switches M2 to M5. In certain embodiments, the resistor 45 may be sized to have a resistance value in a range of about 5Ω to about 100Ω to limit current flow. In other embodiments, the resistor 45 may comprise a larger resistance value, such as 10 kiloohms (kΩ) or more, to provide RF isolation which may reduce or diminish any undesirable impact to isolation provided by the protection network including the first MEMS switch M1.

In a MEMS switch device that includes a first MEMS switch that serves as a degradation protection switch as previously described, degradation of the first MEMS switch may reach a level that prevents it from be able to establish a common potential between an $RF_{in}$ and an $RF_{out}$. In certain embodiments as disclosed herein, additional MEMS switches may be configured in a similar manner to the first MEMS switch such that the MEMS switch device comprises two or more protection switches that collectively serve to protect other MEMS switches in the MEMS switch device from degradation.

Figure 7:
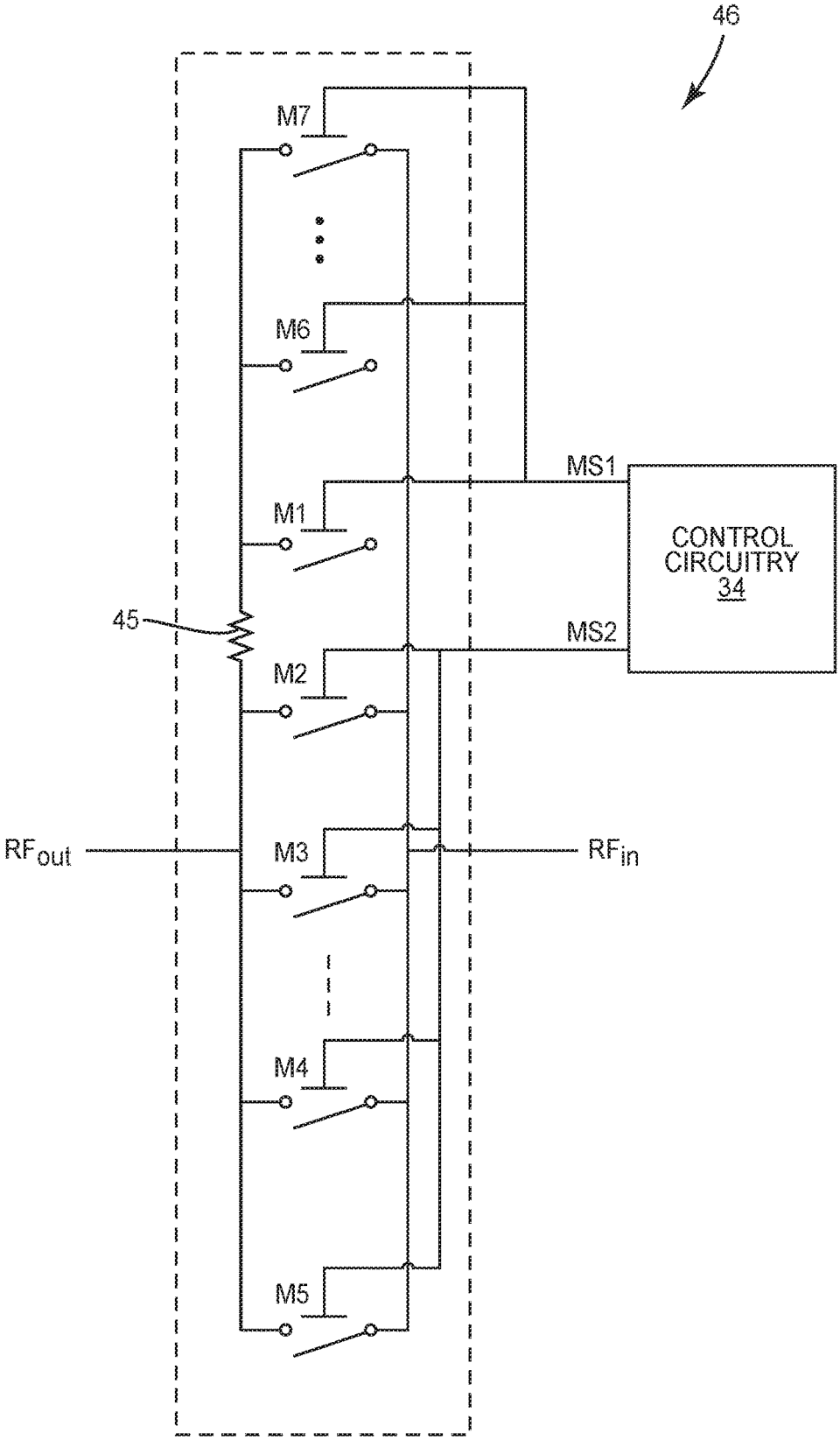
FIG. 7 illustrates a block diagram of a MEMS switch device according to embodiments disclosed herein that includes at least one additional MEMS switch configured to receive a first MEMS control switch signal.

FIG. 7 illustrates a block diagram of a MEMS switch device 46 according to embodiments disclosed herein that includes at least one additional MEMS switch M6, M7 configured to receive the first MEMS control switch signal MS1. The at least one additional MEMS switch M6, M7 is arranged in parallel with the first MEMS switch M1 and the plurality of second MEMS switches M2 to M5. As shown, the control circuitry 34 is configured to provide the first MEMS switch control signal MS1 to the first MEMS switch M1 and the at least one additional MEMS switch M6, M7. The control circuitry 34 additionally is configured to provide the second MEMS switch control signal MS2 to the plurality of second MEMS switches M2 to M5 as previously described. In this manner, the first MEMS control switch M1 and the at least one additional MEMS switch M6, M7 may all be configured as protection switches that are in a closed position while the plurality of second MEMS switches M2 to M5 open and close. Additionally, the resistor 45 may be configured in series with the group of protection switches (M1, M6, M7) to provide RF isolation as previously described. While the plurality of second MEMS switches M2 to M5 are illustrated as five MEMS switches, there may be any number of parallel (N-parallel) MEMS switches as indicated by the vertical dashed line between the second MEMS switches M3 and M4. In a similar manner, as indicated by the dotted vertical line between the at least one additional MEMS switch M6 and M7, the MEMS switch device 46 may include a plurality of additional switches arranged in parallel with the first MEMS switch M1 and the plurality of second MEMS switches M2 to M5, and the plurality of additional MEMS switches are also configured to receive the first MEMS switch control signal MS1.

In various RF applications, a MEMS switch device may be linked to an antenna, cable input, or other type of input that provides a hot switching power source. In certain embodiments as disclosed herein, the MEMS switch device may include a shunt device connected between the hot switching power source and ground that is configured to attenuate power entering the MEMS switch device.

Figure 8:
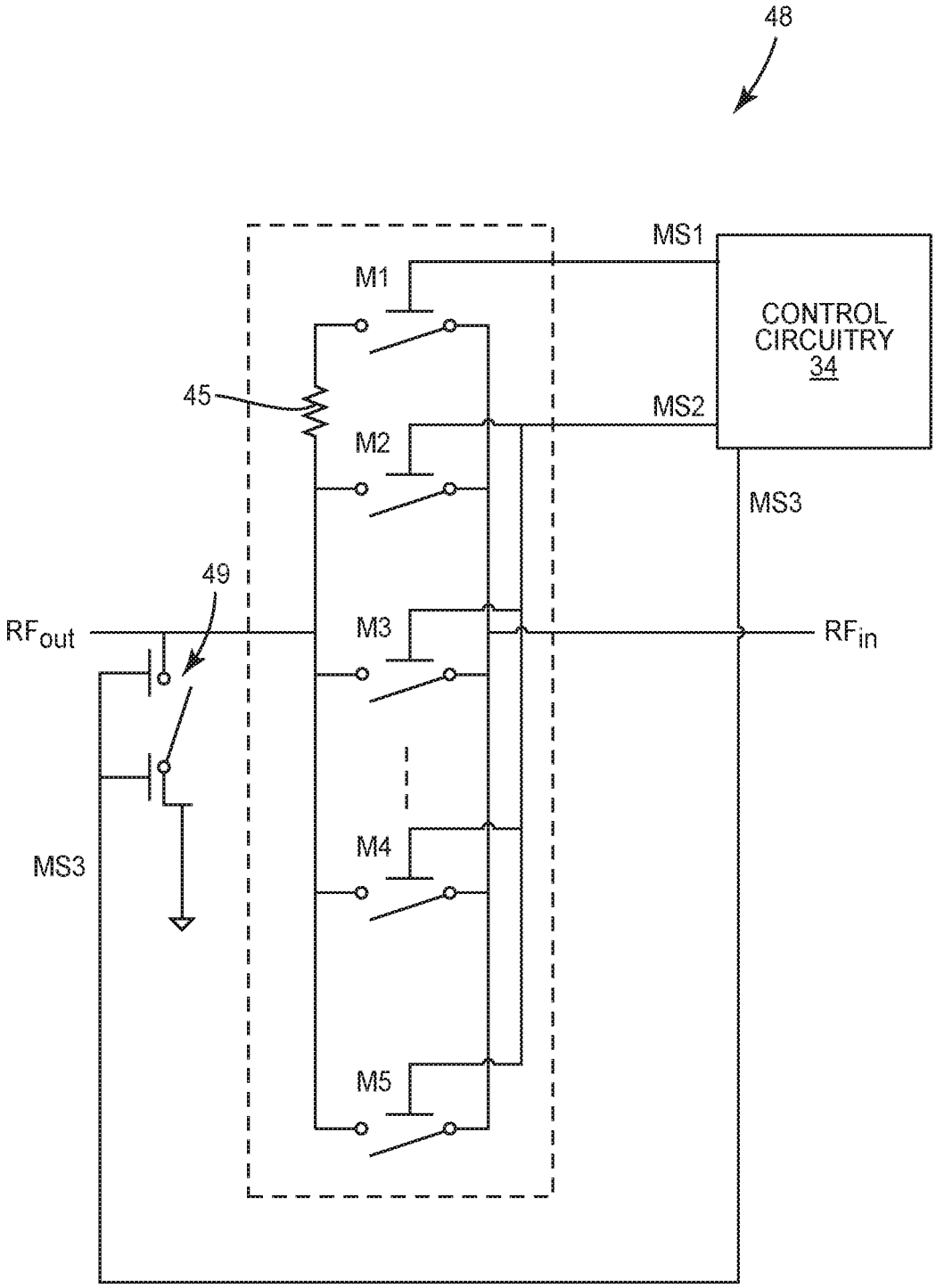
FIG. 8 illustrates a block diagram of a MEMS switch device according to embodiments disclosed herein that includes a shunt device configured to attenuate power entering the MEMS switch device.

FIG. 8 illustrates a block diagram of a MEMS switch device 48 according to embodiments disclosed herein that includes a shunt device 49 configured to attenuate power entering the MEMS switch device 48. The block diagram illustrates the control circuitry 34 configured to provide the first MEMS switch control signal MS1 to the first MEMS switch M1 and the second MEMS switch control signal MS2 to the plurality of second MEMS switches M2 to M5 as previously described. The block diagram also illustrates the resistor 45 in series with the first MEMS switch M1 as previously described. In FIG. 8, the shunt device 49 is connected to ground on the $RF_{out}$ side of the MEMS switch device 48, which may be linked or otherwise connected to an antenna or other hot switching power sources in certain RF applications. In other embodiments, the order may be reversed and the shunt device 49 may be connected to ground on the $RF_{in}$ side. In certain embodiments, the shunt device 49 comprises a shunt MEMS switch that is configured to receive a third MEMS switch control signal MS3 from the control circuitry 34. The third MEMS switch control signal MS3 may be configured to close the shunt device 49 just before the first MEMS switch M1 closes, thereby attenuating power received by the first MEMS switch M1. Accordingly, the first MEMS switch M1 may have a longer lifetime in reducing degradation in the plurality of second MEMS switches M2 to M5 over repeated open and close cycles.

In certain embodiments as disclosed herein, one or more MEMS switches may serve as degradation protection switches for other MEMS switches without the need for separate MEMS switch control signals. In this regard, a MEMS switch device may include a plurality of MEMS switches that are arranged in parallel with each other and the plurality of MEMS switches are configured to receive a common MEMS switch control signal. In certain embodiments, one or more of the MEMS switches may be configured to close before the other MEMS switches in response to the common control signal. This may be accomplished by configuring the one or more MEMS switches with one or more positional and/or structural differences that enable faster closing and slower opening than the other MEMS switches.

Figure 9A:
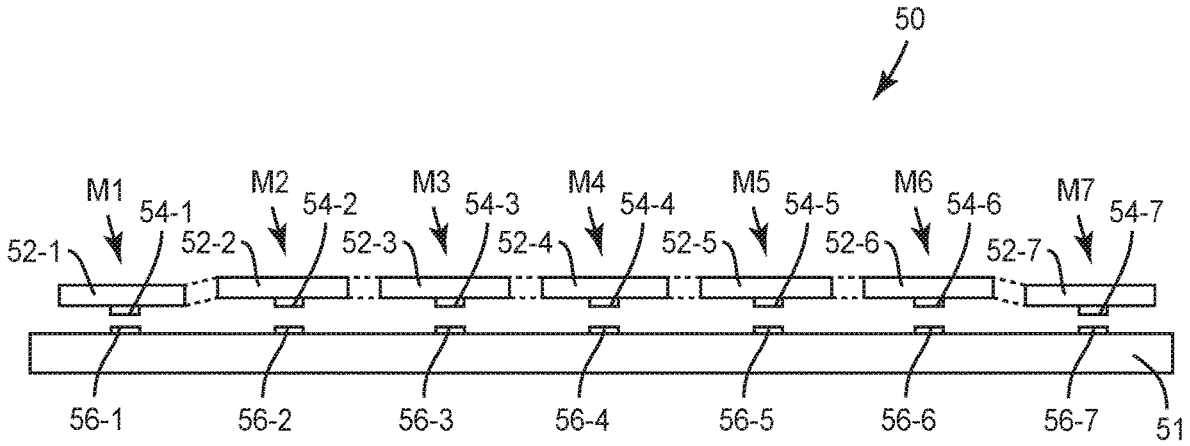
FIGS. 9A-9C illustrates cross-sectional views of a MEMS switch device that includes a plurality of MEMS switches at various steps of an open and close cycle according to embodiments disclosed herein.
Figure 9B:
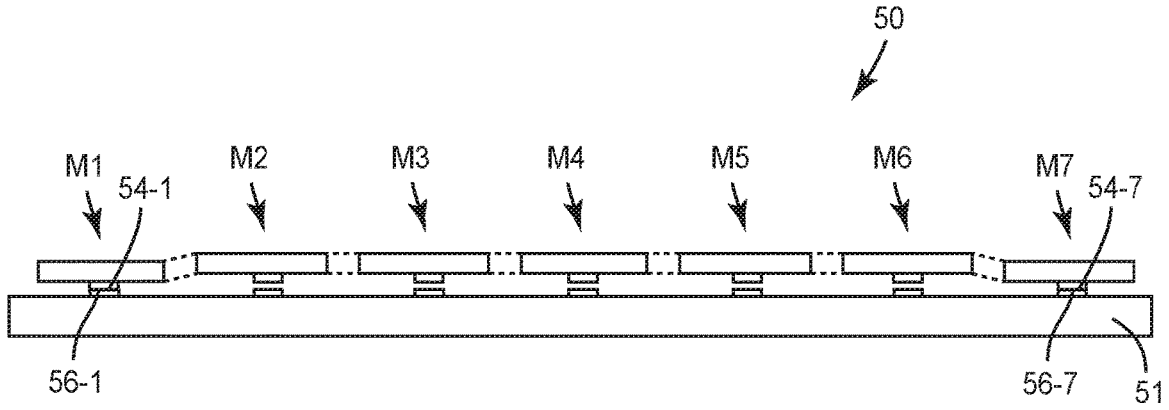
Figure 9C:
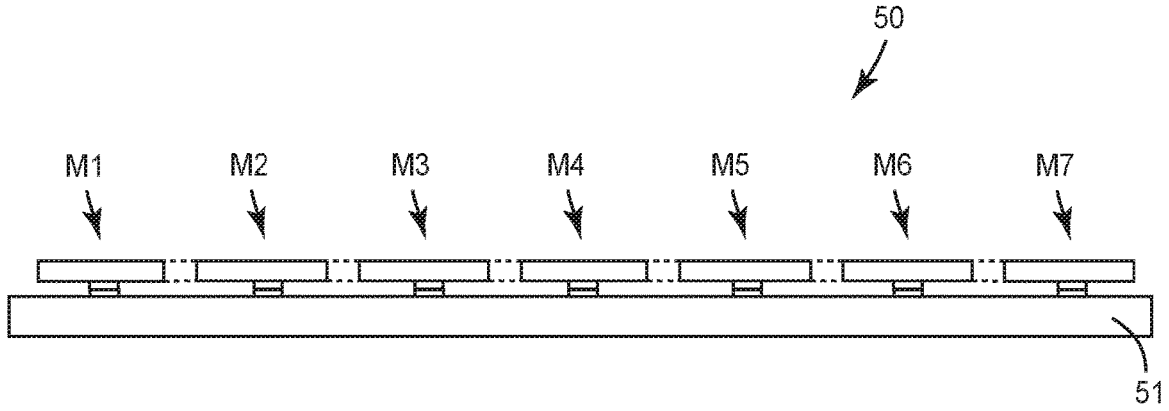

FIG. 9A illustrates a cross-sectional view of a MEMS switch device 50 that includes a plurality of MEMS switches M1 to M7 over a substrate 51. The plurality of MEMS switches M1 to M7 may be configured in parallel with one another as previously described. Each of the MEMS switches M1 to M7 includes a corresponding actuator 52-1 to 52-7 and a corresponding switch contact 54-1 to 54-7. Each of the switch contacts 54-1 to 54-7 is arranged over a corresponding terminal contact 56-1 to 56-7 that is positioned on the substrate 51. As illustrated in FIG. 9A, all of the MEMS switches M1 to M7 are configured in an open position. Notably, a first MEMS switch M1 and/or M7 is configured or positioned closer to the substrate 51 than a second MEMS switch M2 to M6. A common MEMS switch control signal may be applied to the plurality of MEMS switches M1 to M7 to repeatedly open and close the plurality of MEMS switches M1 to M7. FIG. 9B illustrates a cross-sectional view of the MEMS switch device 50 just after the common MEMS switch control signal directs the plurality of MEMS switches M1 to M7 to close. As illustrated, the first MEMS switch M1, M7 closes and makes contact between the switch contact 54-1, 54-7 and the corresponding terminal contact 56-1, 56-7 before the second MEMS switches M2 to M6 are able to close. Accordingly, the first MEMS switch M1, M7 may establish a common potential before the second MEMS switches M2 to M6 close, thereby reducing degradation in the second MEMS switches M2 to M6. FIG. 9C illustrates a cross-sectional view of the MEMS switch device 50 after all of the plurality of MEMS switches M1 to M7 have had time to close in response to the common MEMS switch control signal. When the common MEMS switch control signal directs the plurality of MEMS switches M1 to M7 to reopen, the order of the figures may be reversed such that the second MEMS switches M2 to M6 open first as illustrated in FIG. 9B before all of the MEMS switches M1 to M7 are opened as illustrated in FIG. 9A. In certain embodiments, in order to open and close in such a manner, the second MEMS switches M2 to M6 may comprise the actuators 52-2 to 52-6 with a higher spring constant than the actuators 52-1, 52-7 of the first MEMS switches M1, M7. Accordingly, the first MEMS switches M1, M7 comprise weaker springs that close more easily and open slower than the second MEMS switches M2 to M6 with stronger springs. In certain embodiments, the first MEMS switches M1, M7 may comprise a lighter mass than the second MEMS switches M2 to M6 in order to achieve different open and close timings. Accordingly, in certain embodiments, a method of operating the MEMS switch device 50 includes closing the first MEMS switch M1, M7 before closing the second MEMS switch M2 to M6 by sending the common MEMS switch control signal to both the first MEMS switch M1, M7 and the second MEMS switch M2 to M6. As with previous embodiments, while only seven MEMS switches are illustrated, a MEMS switch device as described herein may include any number of MEMS switches. For example, the MEMS switch device may include a number in a range of about two to about one hundred MEMS switches or more.

Those skilled in the art will recognize improvements and modifications to the preferred embodiments of the present disclosure. All such improvements and modifications are considered within the scope of the concepts disclosed herein and the claims that follow.

What is claimed is:

1. A microelectromechanical system (MEMS) switch device comprising:

a first MEMS switch configured to receive a first MEMS switch control signal;

a plurality of second MEMs switches configured to receive a second MEMS switch control signal that is different than the first MEMS switch control signal, wherein the first MEMS switch and the plurality of second MEMS switches are arranged in parallel with each other; and control circuitry configured to provide the first MEMS switch control signal and the second MEMS switch control signal.

2. The MEMS switch device of claim 1, wherein the first MEMS switch is configured to close before the plurality of second MEMS switches close during an open and close cycle.

3. The MEMS switch device of claim 2, wherein the first MEMS switch is configured to reopen after the plurality of second MEMS switches reopen during the open and close cycle.

4. The MEMS switch device of claim 1, wherein the first MEMS switch is configured to (i) close before the plurality of second MEMS switches close, (ii) reopen after the plurality of second MEMS switches close, (iii) close again before the plurality of second MEMS switches open, and (iv) reopen again after the plurality of second MEMS switches open during an open and close cycle.

5. The MEMS switch device of claim 1, further comprising a resistor configured in series with the first MEMS switch.

6. The MEMS switch device of claim 1, further comprising an additional MEMS switch arranged in parallel with the first MEMS switch and the plurality of second MEMS switches, wherein the additional MEMS switch is configured to receive the first MEMS switch control signal.

7. The MEMS switch device of claim 6, further comprising a resistor configured in series with the first MEMS switch and the additional MEMS switch.

8. The MEMS switch device of claim 1, further comprising a plurality of additional switches arranged in parallel with the first MEMS switch and the plurality of second MEMS switches, wherein the plurality of additional MEMS switches are configured to receive the first MEMS switch control signal.

9. The MEMS switch device of claim 1, further comprising a shunt device that is connected to ground.

10. The MEMS switch device of claim 9, wherein the shunt device comprises a shunt MEMS switch configured to receive a third MEMS switch control signal.

11. The MEMS switch device of claim 1, wherein the plurality of second MEMS switches comprises a range of about two to about one hundred MEMS switches.

12. A method of operating a microelectromechanical system (MEMS) switch device comprising:

providing a plurality of MEMS switches that are arranged in parallel with each other;

closing a first MEMS switch of the plurality of MEMS switches before closing a second MEMS switch of the plurality of MEMS switches; and opening the second MEMS switch of the plurality of MEMS switches before opening the first MEMS switch of the plurality of MEMS switches.

13. The method of claim 12, wherein closing the first MEMS switch comprises sending a first MEMS switch control signal to the first MEMS switch, and closing the second MEMS switch comprises sending a second MEMS switch control signal to the second MEMS switch.

14. The method of claim 12, wherein closing the first MEMS switch and closing the second MEMS switch comprises sending a common MEMS switch control signal to both the first MEMS switch and the second MEMS switch.

15. A microelectromechanical system (MEMS) switch device comprising:

a plurality of MEMS switches that are arranged in parallel with each other, wherein the plurality of MEMS switches are configured to receive a common MEMS switch control signal; and control circuitry configured to provide the common MEMS switch control signal;

wherein a first MEMS switch of the plurality of MEMS switches is configured to close before a second MEMS switch of the plurality of MEMS switches in response to the common MEMS switch control signal.

16. The MEMS switch device of claim 15, wherein the first MEMS switch of the plurality of MEMS switches is configured to open after the second MEMS switch of the plurality of MEMS switches in response to the common MEMS switch control signal.

17. The MEMS switch device of claim 15, wherein the first MEMS switch comprises a first switch contact over a substrate and the second MEMS switch comprises a second switch contact over the substrate, and in an open position, the first switch contact is configured closer to the substrate than the second switch contact.

18. The MEMS switch device of claim 15, wherein the first MEMS switch comprises a first actuator and the second MEMS switch comprises a second actuator, and the second actuator has a higher spring constant than the first actuator.

19. The MEMS switch device of claim 15, wherein the first MEMS switch comprises a lighter mass than the second MEMS switch.

20. The MEMS switch device of claim 15, wherein the plurality of MEMS switches comprises a range of about two to about one hundred MEMS switches.

* * * * *